US009914016B2

(12) United States Patent
Lin

(10) Patent No.: US 9,914,016 B2
(45) Date of Patent: Mar. 13, 2018

(54) ELLIPTICAL CLIMBING EXERCISE APPARATUS

(71) Applicant: REXON INDUSTRIAL CORP., LTD., Taichung (TW)

(72) Inventor: Hung Chi Lin, Taichung (TW)

(73) Assignee: Rexon Industrial Corp., Ltd., Tali, Taichung (TW)

( * ) Notice: Subject to any disclaimer, the term of this patent is extended or adjusted under 35 U.S.C. 154(b) by 0 days.

(21) Appl. No.: 15/368,736

(22) Filed: Dec. 5, 2016

(65) Prior Publication Data

US 2017/0157460 A1 Jun. 8, 2017

(30) Foreign Application Priority Data

Dec. 8, 2015 (TW) ..... 104141029 A

(51) Int. Cl.

| | |
|---|---|
| ***A63B 22/00*** | (2006.01) |
| ***A63B 22/06*** | (2006.01) |
| ***A63B 21/00*** | (2006.01) |
| *A63B 21/22* | (2006.01) |
| *A63B 69/00* | (2006.01) |

(52) U.S. Cl.

CPC ..... *A63B 22/0664* (2013.01); *A63B 21/4034* (2015.10); *A63B 22/0015* (2013.01); *A63B 22/0046* (2013.01); *A63B 21/225* (2013.01); *A63B 69/0057* (2013.01); *A63B 2022/002* (2013.01); *A63B 2022/0676* (2013.01)

(58) Field of Classification Search

None

See application file for complete search history.

(56) References Cited

U.S. PATENT DOCUMENTS

| | | | | |
|---|---|---|---|---|
| 5,865,712 | A * | 2/1999 | Chang | A63B 22/001 482/52 |
| 6,142,915 | A * | 11/2000 | Eschenbach | A63B 22/001 482/52 |
| 9,039,577 | B2 * | 5/2015 | Peng | A63B 22/001 482/52 |
| 9,050,485 | B2 * | 6/2015 | Huang | A63B 22/001 |
| 9,527,547 | B2 * | 12/2016 | Thomas | B62M 1/26 |
| 2007/0072742 | A1 * | 3/2007 | Chen | A63B 22/001 482/52 |
| 2014/0243157 | A1 * | 8/2014 | Huang | A63B 22/001 482/52 |
| 2017/0157460 | A1 * | 6/2017 | Lin | A63B 22/0015 |

* cited by examiner

*Primary Examiner* — Stephen R Crow

(74) *Attorney, Agent, or Firm* — Bacon & Thomas, PLLC

(57) ABSTRACT

An elliptical climbing exercise apparatus includes a base frame, a swing unit including a pair of swing arms, a pedal unit including a pair of pedal shafts respectively pivotally connected to the swing arms, a damping unit including a rotating wheel with a spindle, a guiding unit including a pair of cranks respectively affixed to the two opposite ends of the spindle, a pair of rockers respectively pivotally connected to the cranks and a pair of links respectively pivotally connected to the rocker. Cooperation between the base frame, the swing unit, the pedal unit, the resistance unit and the guiding unit is used to achieve a training of the leg muscles.

4 Claims, 6 Drawing Sheets

ELLIPTICAL CLIMBING EXERCISE APPARATUS

BACKGROUND OF THE INVENTION

1. Field of the Invention

The present invention relates to fitness equipment technology and more particularly, to an elliptical climbing exercise apparatus.

2. Description of the Related Art

A climbing exercise apparatus is known (Taiwan Patent No. 355379), comprising a base frame, a pair of rotating rods pivotally connected to a pivot holder at the front side of the base frame, a pin mounted at each rotating rod near a distal end thereof, and a tilt adjustment rack having a plurality of adjustment holes for receiving the pins selectively. The tilt angle can be adjusted by removing the pins from the tilt adjustment rack, and then biasing the tilt adjustment rack relative to the rotating rods to the desired tilt angle, and then fastening the pins to the respective adjustment holes.

The above prior art climbing exercise apparatus allows adjustment of the span. However, when an adjustment of the span is needed, the user must lift the front end of the climbing exercise apparatus before adjustment, or the adjustment can be performed as the climbing exercise apparatus is folded up. Thus, the adjustment procedure is complicated and inconvenient.

SUMMARY OF THE INVENTION

The present invention has been developed in view of the circumstances discussed above. It is one of the main objects of the present invention to provide an elliptical climbing exercise apparatus, which is practical for training leg muscles.

To achieve this and other objects of the present invention, an elliptical climbing exercise apparatus comprises a base frame, a swing unit, a pedal unit, a damping unit, and a guiding unit. The base frame comprises a base, and an upright support fixedly mounted at the base. The swing unit comprises a pair of swing arms pivotally connected to the upright support and swingeable back and forth relative to the upright support. Each swing arm comprises a tubular pivot connection portion pivotally connected to the upright support, and a swinging portion opposite to the tubular pivot connection portion. The pedal unit comprises a pair of pedal shafts respectively pivotally connected to the swing arms. Each pedal shaft comprises a front end portion pivotally connected to one respective swinging portion, and a rear end portion opposite to the front end portion. The damping unit is adapted for providing swing damping to the pedal shafts, comprising a rotating wheel. The rotating wheel comprises a spindle axially mounted at the base frame. The guiding unit comprises a pair of cranks respectively fixedly connected to two opposite ends of the spindle and adapted for rotating the rotating wheel, a pair of rockers respectively pivotally connected to the cranks, and a pair of links respectively pivotally connected to the cranks. Each rocker comprises a middle pivot-connecting portion pivotally connected to one respective crank, a rear pivot-connecting portion located at one end thereof and pivotally connected to the rear end portion of one respective pedal shaft, and a front pivot-connecting portion located at an opposite end thereof and pivotally connected to one respective link. Each link comprises a constrained end portion disposed opposite to the front pivot-connecting portion of the mating rocker and positionable relative to the base frame.

Thus, cooperation between the base frame, the swing unit, the pedal unit, the resistance unit, and the guiding unit is used to achieve the training of the leg muscles.

Other advantages and features of the present invention will be fully understood by reference to the following specification in conjunction with the accompanying drawings, in which like reference signs denote like components of structure.

DETAILED DESCRIPTION OF THE INVENTION

Figure 1:
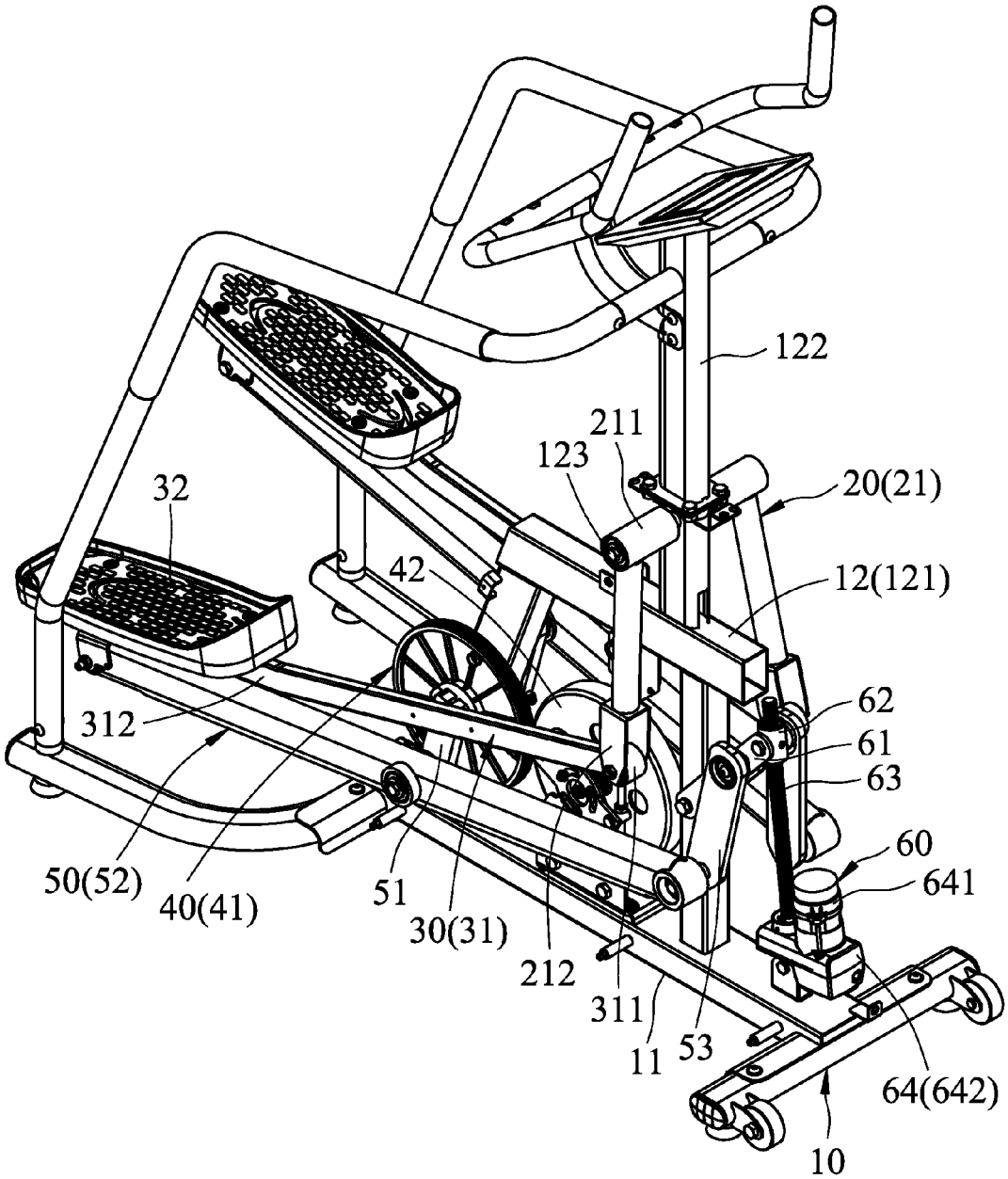
FIG. 1 is an oblique top elevational view of an elliptical climbing exercise apparatus in accordance with the present invention.
Figure 2:
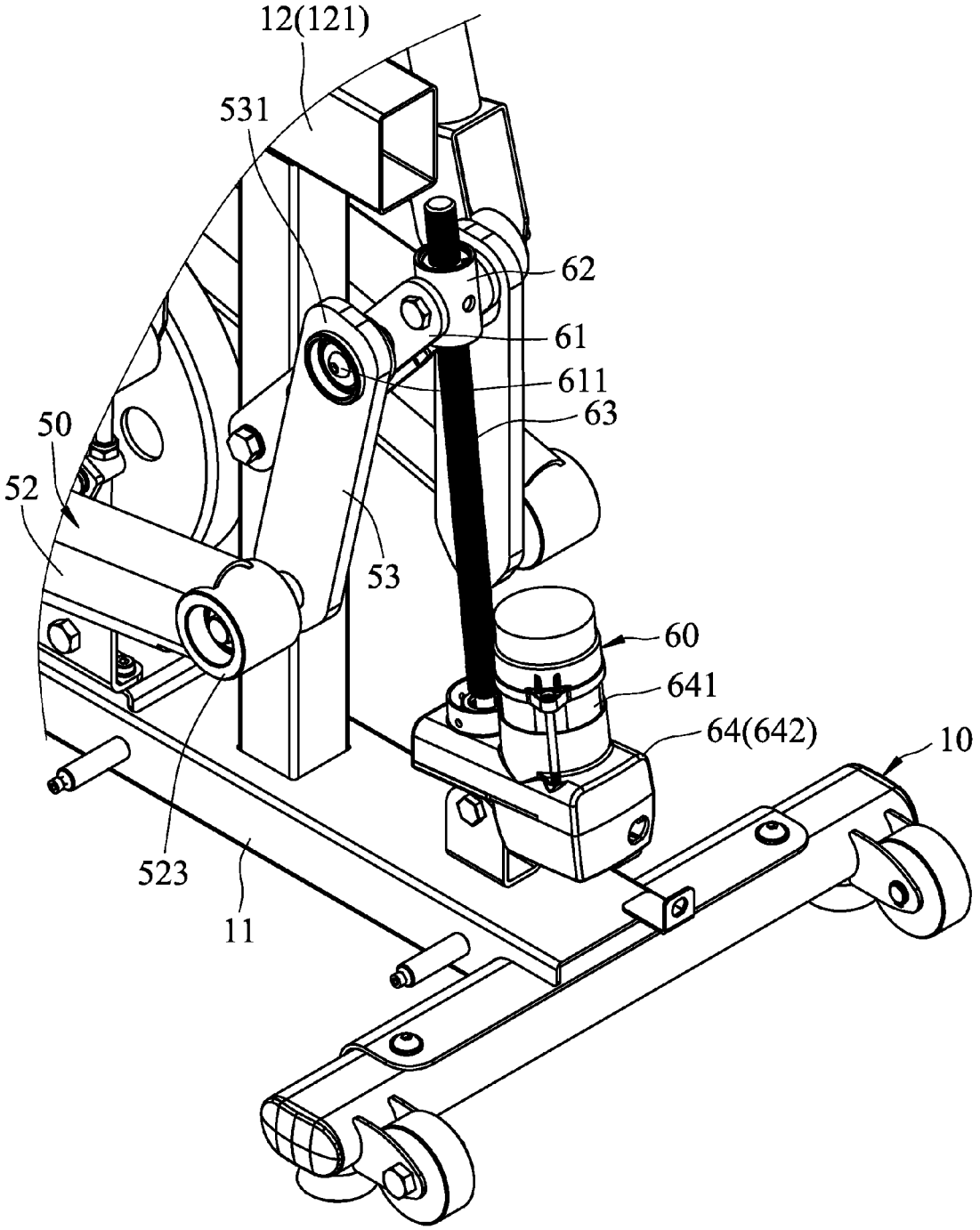
FIG. 2 is an elevational view of a part of the elliptical climbing exercise apparatus in accordance with the present invention.

Referring to FIGS. 1 and 2, an elliptical climbing exercise apparatus in accordance with the present invention is shown. The elliptical climbing exercise apparatus comprises a base frame 10, a swing unit 20, a pedal unit 30, a damping unit 40, a guiding unit 50, and an adjustment unit 60.

The base frame 10 comprises a base 11, and an upright support 12 fixedly mounted at a front side of the base 11. The upright support 12 comprises a mount 121 fixedly mounted, e.g., bolted, screwed, welded, etc., at the base 11, an upright post 122 located at a top side of the mount 121, and a transverse axle 123 affixed to the upright post 122 near the mount 121.

The swing unit 20 comprises a pair of swing arms 21 axially pivotally connected to the transverse axle 123 of the upright support 12 and alternatively movable back and forth relative to the base frame 10. Each swing arm 21 comprises a tubular pivot connection portion 211 located at one end thereof and pivotally connected to a respective one end of the transverse axle 123, and a swinging portion 212 located at an opposite end thereof.

The pedal unit 30 comprises a pair of pedal shafts 31 respectively pivotally connected to the swing arms 21 of the swing unit 20, and a pair of pedals 32 respectively mounted at the pedal shafts 31. Each pedal shaft 31 comprises a front end portion 311 pivotally connected to the swinging portion 212 of one respective swing arm 21, and an opposing rear end portion 312. The pedals 32 are respectively mounted at the rear end portions 312 of the pedal shafts 31.

The damping unit 40 is configured to provide a damping resistance to the pedal shafts 31, comprising a rotating wheel 41 rotatably mounted on the mount 121 and a damping wheel 42 mounted on the mount 121 and rotatable by the rotating wheel 41. The rotating wheel 41 comprises a spindle 411 axially located at the center and axially mounted at the mount 121. The damping wheel 42 can be an inertial wheel or a magnetic-control wheel or similar wheel as known in the art.

The guiding unit 50 comprises a pair of cranks 51 respectively fixedly connected to two opposite ends of the spindle 411 and adapted for rotating the rotating wheel 41, a pair of rockers 52 respectively pivotally connected to the cranks 51, and a pair of links 53 respectively pivotally connected to the cranks 51. Each rocker 52 comprises a middle pivot-connecting portion 521 pivotally connected to one respective crank 51, a rear pivot-connecting portion 522 located at one end thereof and pivotally connected to the rear end portion 312 of one respective pedal shaft 31, and a front pivot-connecting portion 523 located at an opposite end thereof and pivotally connected to one respective link 53. Each link 53 comprises a constrained end portion 531 opposite to the front pivot-connecting portion 523 of the mating rocker 52.

Figure 4:
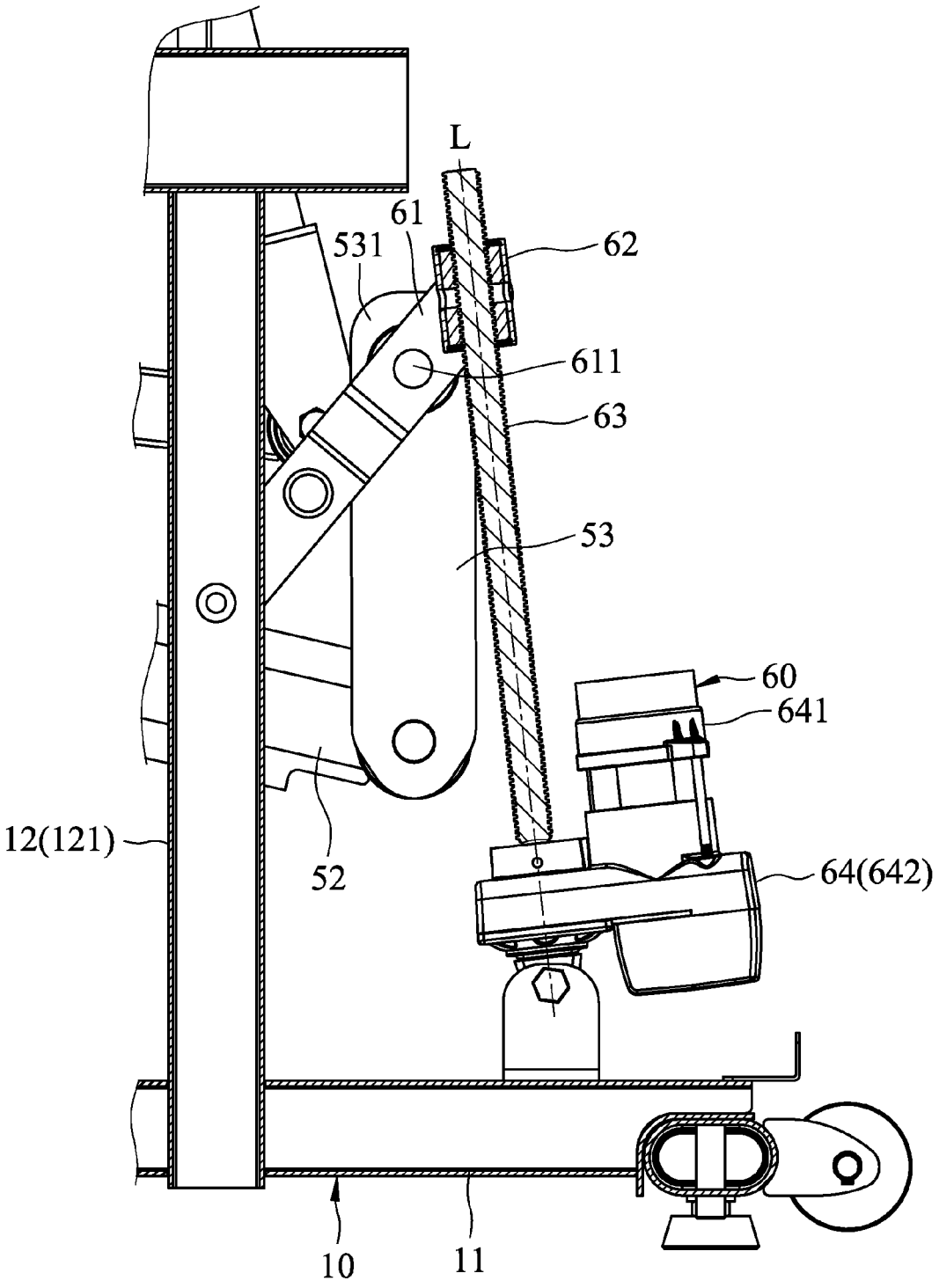
FIG. 4 is a schematic sectional view of the elliptical climbing exercise apparatus in accordance with the present invention.

Referring also to FIG. 4, the adjustment unit 60 is mounted at the base frame 10 and adapted for moving the constrained end portions 531 of the links 53 relative to the upright support 12 to adjust the span between the rear pivot-connecting portions 522 of the rockers 52. The adjustment unit 60 comprises an interlocking member 61 pivotally connected to a front side of the upright support 12, a screw nut 62 pivotally connected to the interlocking member 61, a screw rod 63 threaded into the screw nut 62, and a driver 64 pivotally connected to the base 11. The interlocking member 61 comprises a shaft 611 pivotally connected with the constrained end portions 531 of the links 53. The screw nut 62 is located at one end of the shaft 611. In the present preferred embodiment, the driver 64 comprises a servo motor 641 and a gearbox 642 for transferring the energy of the servo motor 641. The screw rod 63 is connected to the output end of the gearbox 642. Starting the servo motor 641 can rotate the screw rod 63, causing the interlocking member 53 to be moved along the screw rod 63 and biased relative to the upright support 12. Further, the screw rod 63 extends along an axis L that defines with the base 11 a contained angle of about 90~75°.

Figure 3:
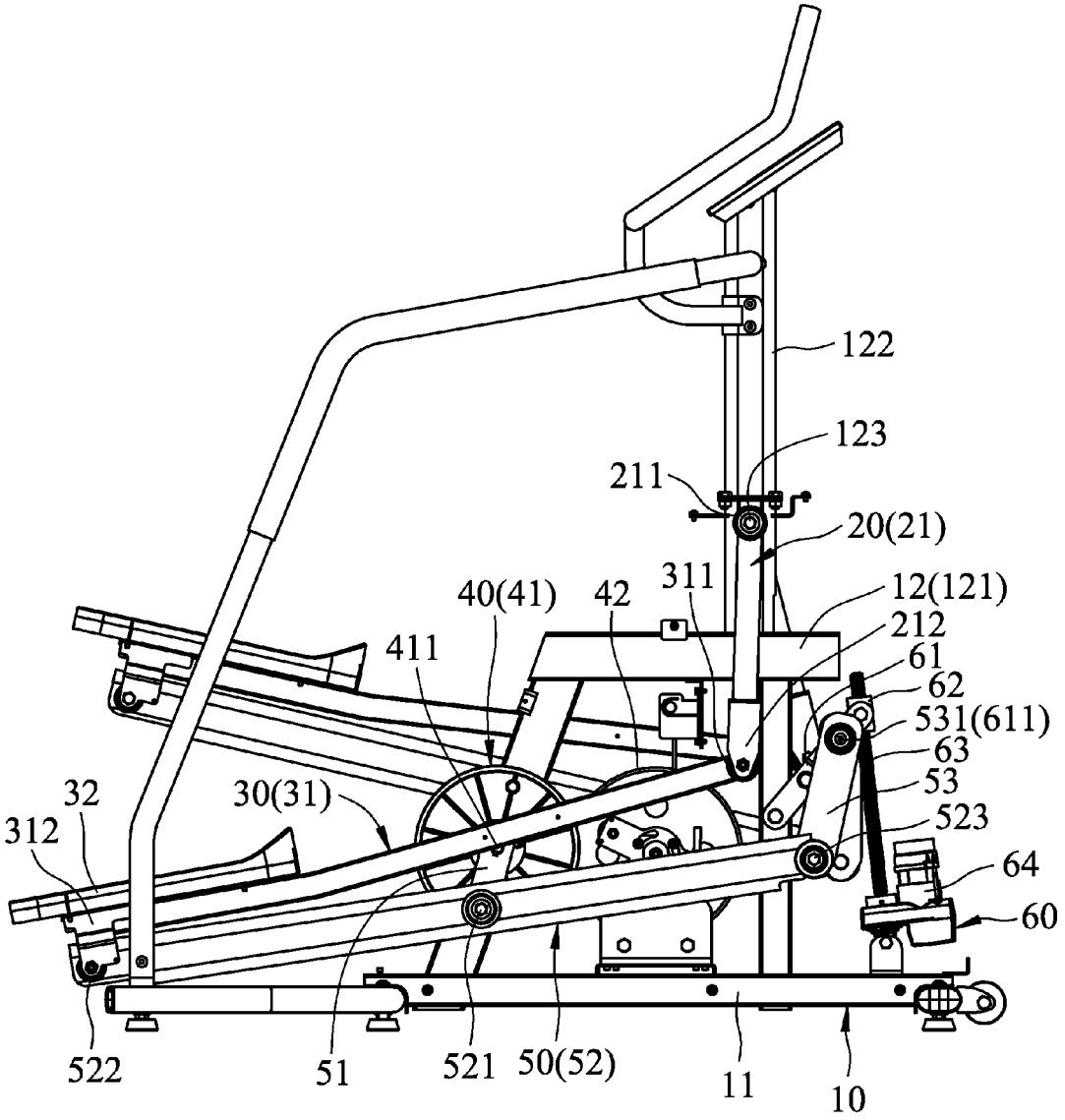
FIG. 3 is a schematic front plain view of the elliptical climbing exercise apparatus in accordance with the present invention.

The use and application of the elliptical climbing exercise apparatus is explained hereinafter with reference to FIGS. 3 and 4. For example, a user can use his or her legs to give a pressure to the pedals 32 and the pedal shafts 31 horizontally forwards in an alternating manner, forcing the front end portions 311 of the pedal shafts 31 to move the swinging portions 212 of the swing arms 21 and causing the swing arms 21 to turn back and forth about the transverse axle 123. At the same time, the rockers 52 and the cranks 51 are moved by the respective pedal shafts 31 to rotate the rotating wheel 41, causing rotation of the damping wheel 42 to generate a damping resistance, and thus, the expected exercise goal is achieved.

Figure 5:
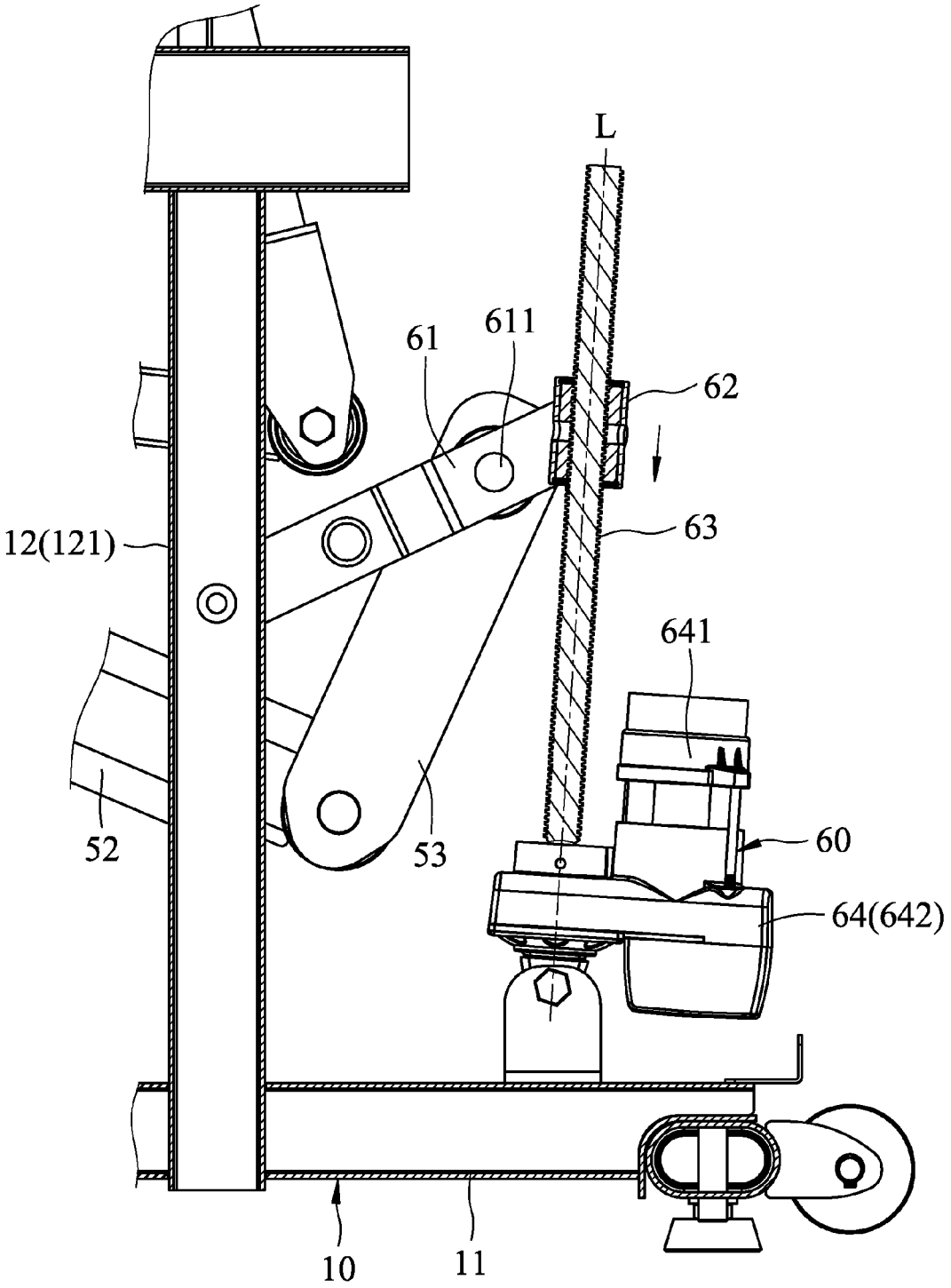
FIG. 5 is a schematic drawing of the present invention, illustrating an adjustment of the adjustment unit.
Figure 6:
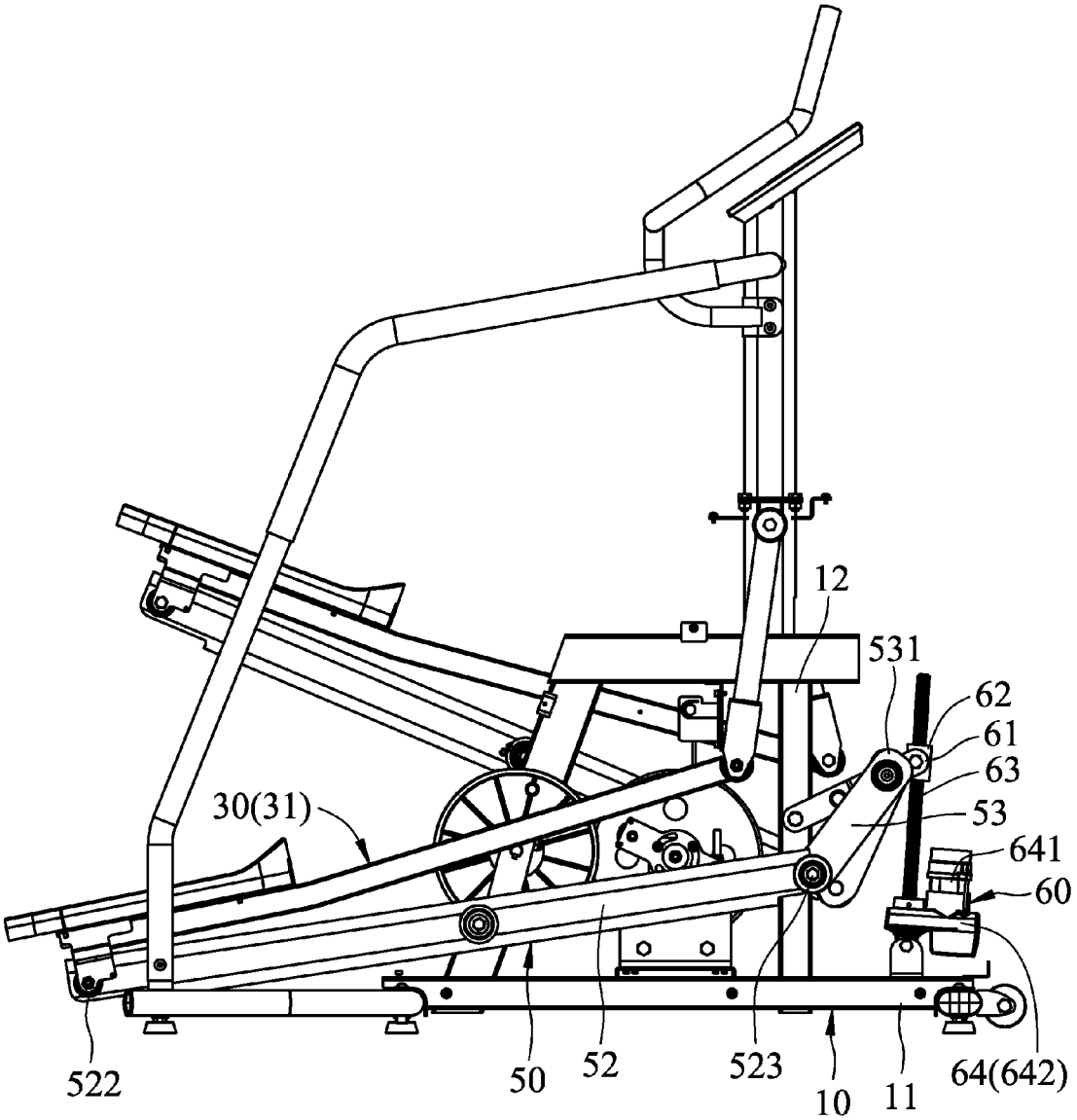
FIG. 6 is similar to FIG. 4, illustrating the status of the component parts of the elliptical climbing exercise apparatus after an adjustment of the adjustment unit.

Referring to FIGS. 5 and 6, when the user turns on, e.g., a switch or button at the motor or from a control unit or handles mounted on the upright post 122, the servo motor 641 of the adjustment unit 60, the servo motor 641 is configured to rotate the screw rod 63 and to further move the screw nut 62 toward the gearbox 642, which causes movement of the interlocking member 61 and the links 53, i.e., the constrained end portions 531 of the links 53 are alternately moved back and forth relative to the upright support 12, and thus, the elevation of the front pivot-connecting portions 523 of the rockers 52 relative to the base 11 and the span between the rear pivot-connecting portions 522 of the rockers 52 are relatively adjusted. After adjustment of the elevation of the front pivot-connecting portions 523 of the rockers 52, the pedal shafts 31 are respectively moved by the rockers 52, achieving adjustment of the span between the pedal shafts 31 according to the user's needs for training the leg muscles.

Further, in view of the arrangement that the adjustment unit 60 is mounted at the base 11 of the base frame 10, the axis L of the screw rod 62 defines with the base 11 a contained angle of about 90+75°, and the screw rod 62 does not protrude over the front side of the base 11, the overall dimension of the elliptical climbing exercise apparatus is minimized, which saves installation space.

Thus, the invention uses the adjustment unit 60 to control the swinging of the constrained end portions 531 of the links 53 relative to the upright support 12, thereby adjusting the span between the rear pivot-connecting portions 522 of the rockers 52. In so doing the whole structure of the elliptical climbing exercise apparatus of the present invention is simple. Further, the adjustment of the span between the rear pivot-connecting portions 522 of the rockers 52 can be done in an easy manner and stepless manner.

Furthermore, the elliptical climbing exercise apparatus can be configured consisting of the base frame 10, the swing unit 20, the pedal unit 30, the damping unit 40 and the guiding unit 50 without the adjustment unit 60, to achieve the same effect of training the leg muscles.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An elliptical climbing exercise apparatus, comprising:

a base frame comprising a base and an upright support fixedly mounted to said base;

a swing unit comprising a pair of swing arms pivotally connected to said upright support and swingeable back and forth relative to said upright support, each of said swing arms comprising a tubular pivot connection portion pivotally connected to said upright support and a swinging portion connected opposite to said tubular pivot connection portion;

a pedal unit comprising a pair of pedal shafts respectively pivotally connected to said swing arms, each of said pedal shafts comprising a front end portion pivotally connected to one respective said swinging portion and a rear end portion opposite to said front end portion;

a damping unit adapted for providing swing damping to said pedal shafts, said damping unit comprising a rotating wheel, said rotating wheel comprising a spindle axially mounted to said base frame; and a guiding unit comprising a pair of cranks respectively fixedly connected to two opposite ends of said spindle and adapted for rotating said rotating wheel, a pair of rockers respectively pivotally connected to said cranks, and a pair of links respectively pivotally connected to said cranks, each of said rockers comprising a middle pivot-connecting portion pivotally connected to one respective crank, a rear pivot-connecting portion located at one end thereof and pivotally connected to said rear end portion of one respective pedal shaft, and a front pivot-connecting portion located at an opposite end thereof and pivotally connected to one respective link, each said link comprising a constrained end portion disposed opposite to the said front pivot-connecting portion of the respective rocker and positionable relative to said base frame.

2. The elliptical climbing exercise apparatus as claimed in claim 1, further comprising an adjustment unit mounted to said base frame and adapted for adjusting a span between said rear pivot-connecting portions of said rockers, said adjustment unit comprising an interlocking member pivotally connected to a front side of said upright support, a screw nut pivotally connected to said interlocking member, a screw rod threaded into said screw nut and a driver pivotally connected to said base, said interlocking member comprising a shaft pivotally connected with the said constrained end portions of said links, said screw nut being located at one end of said shaft, said driver being operable to rotate said screw rod to further cause movement of said interlocking member along said screw rod and biasing of said interlocking member relative to said upright support to adjust the span between said rear pivot-connecting portions of said rockers.

3. The elliptical climbing exercise apparatus as claimed in claim 2, wherein said driver of said adjustment unit comprises a servo motor and a gearbox for transferring the energy of said servo motor, said gearbox having an output end thereof connected to said screw rod for driving said screw rod to rotate when said servo motor is started.

4. The elliptical climbing exercise apparatus as claimed in claim 3, wherein said screw rod extends along an axis that defines with said base a contained angle of about 90~75°.

* * * * *